US009937405B2

(12) United States Patent
Rodgers et al.

(10) Patent No.: US 9,937,405 B2
(45) Date of Patent: Apr. 10, 2018

(54) MOUTH-GUARD WITH INSERT

(71) Applicant: THNK, INC., Lubbock, TX (US)

(72) Inventors: Trafton Rodgers, Lubbock, TX (US); Kurt Niederer, Pineville, NC (US)

(73) Assignee: THNK, INC., Lubbock, TX (US)

( * ) Notice: Subject to any disclaimer, the term of this patent is extended or adjusted under 35 U.S.C. 154(b) by 285 days.

(21) Appl. No.: 14/647,727

(22) PCT Filed: Nov. 27, 2013

(86) PCT No.: PCT/US2013/072281
§ 371 (c)(1),
(2) Date: May 27, 2015

(87) PCT Pub. No.: WO2014/085618
PCT Pub. Date: Jun. 5, 2014

(65) Prior Publication Data

US 2015/0258417 A1 Sep. 17, 2015

Related U.S. Application Data

(60) Provisional application No. 61/730,195, filed on Nov. 27, 2012.

(51) Int. Cl.
*A61C 19/06* (2006.01)
*A63B 71/08* (2006.01)

(52) U.S. Cl.
CPC ..... *A63B 71/085* (2013.01); *A63B 71/081* (2013.01); *A63B 2071/086* (2013.01); *A63B 2071/088* (2013.01)

(58) Field of Classification Search
USPC ..... 128/862, 861
See application file for complete search history.

(56) References Cited

U.S. PATENT DOCUMENTS

| | | | | |
|---|---|---|---|---|
| 5,082,007 | A * | 1/1992 | Adell | A63B 71/085 128/859 |
| 5,293,880 | A | 3/1994 | Levitt | |
| 5,924,863 | A | 7/1999 | Jacobs et al. | |
| 7,708,018 | B1 | 5/2010 | Hirshberg | |
| 8,931,488 | B2 * | 1/2015 | Evans | A63B 71/085 128/859 |
| 8,978,659 | B2 * | 3/2015 | Bardach | A61C 19/063 128/846 |
| 2011/0005531 | A1 * | 1/2011 | Manzo | A63B 71/085 128/862 |

(Continued)

OTHER PUBLICATIONS

Apr. 18, 2014 Search Report issued in International Application No. PCT/US2013/072281.

*Primary Examiner* — Kim M Lewis
(74) *Attorney, Agent, or Firm* — Oliff PLC

(57) ABSTRACT

A mouth-guard to be worn by a user includes a main body including a channel, one or more gum protrusions, and a slot; and an insert configured to be inserted into the slot. The insert for the mouth-guard includes one or more liquid chambers and one or more initial orifices on the surface of the insert where each initial orifice is configured to transport liquid from the one or more liquid chambers to an orifice of the main body such that the liquid passes through the orifice of the main body into a user's mouth.

14 Claims, 10 Drawing Sheets

(56) References Cited

U.S. PATENT DOCUMENTS

| | | | | |
|---|---|---|---|---|
| 2012/0279506 | A1* | 11/2012 | Thompson | A63B 71/085 128/861 |
| 2012/0318280 | A1* | 12/2012 | Maurello | A63B 71/085 128/862 |

* cited by examiner

MOUTH-GUARD WITH INSERT

CROSS-REFERENCE TO RELATED APPLICATION

This application claims priority to Provisional Application No. 61/730,195, filed Nov. 27, 2012, the disclosure of which is hereby incorporated by reference in its entirety.

BACKGROUND

Athletes, particularly those participating in contact sports often wear a protective device for the mouth that covers the teeth and gums to prevent and reduce injury to the teeth, arches, lips and gums known as a mouth-guard. The device may also be described as a mouth protector, mouth piece, gumshield, gumguard, nightguard, occlusal splint, bite splint, or bite plane. The American Dental Association (ADA) recommends mouth-guards be used in twenty-nine sports: acrobatics, basketball, bicycling, boxing, equestrian, football, gymnastics, handball, ice hockey, inline skating, lacrosse, martial arts, racquetball, rugby football, shot putting, skateboarding, skiing, skydiving, soccer, softball, squash, surfing, volleyball, water polo, weightlifting, and wrestling. Mouth-guards may also be used to prevent or reduce the effects of concussions.

SUMMARY

In embodiments, a mouth-guard may be worn by a user. The mouth-guard includes a in body with a channel, one or more gum protrusions, and a slot; and an insert configured to be inserted into the slot. The insert for the mouth-guard may include one or mere liquid chambers and one or more initial orifices on the surface of the insert where each initial orifice is configured to transport liquid from the one or more liquid chambers to an orifice of the main body such that the liquid passes through the orifice of the main body into a user's mouth.

BRIEF DESCRIPTION THE DRAWINGS

DETAILED DESCRIPTION OF THE EMBODIMENTS

The exemplary embodiments described herein provide detail for illustrative purposes and are subject to many variations in structure and design. It should be emphasized, however, that the present invention is not limited to a particularly disclosed embodiment shown or described. It is understood that various Omissions and substitutions of equivalents are contemplated as circumstances may suggest or render expedient, but these are intended to cover the application or implementation without departing from the spirit or scope of the claims of the present invention. Different features from various embodiments may be combined to form additional variations of the exemplary versions of the invention shown and described herein. Also, it is to be understood that the phraseology and terminology used herein is for the purpose of description and should not be regarded as limiting. The terms "a," "an," and "the" herein do not denote a limitation of quantity, but rather denote the presence of at least one of the referenced object. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

There is a need to provide a mouth-guard product that (1) provides a sufficient protection for a user to reduce injury to the teeth, arches, lips, and gums; (2) prevents concussions; and (3) delivers enhancements to augment the competitive ability of the user. Embodiments of the mouth-guard with insert address one or more of these needs.

In embodiments, a mouth-guard includes a main body with a channel, one or more gum protrusions, and a slot; and an insert configured to be inserted into the slot. The insert for the mouth-guard may include one or more liquid chambers and one or more initial orifices on the surface of the insert where each initial orifice is configured to transport liquid from the one or more liquid chambers to an orifice of the main body such that the liquid passes through the orifice of the main body into a user's mouth.

The above described embodiments are illustrated in the figures, which are described in greater detail as follows.

Mouth-Guard

In embodiments, a mouth-guard may be worn in a user's mouth. The mouth-guard may include a main body including a channel, one or more gum protrusions, and a slot; and an insert configured to be inserted into the slot. The components of the mouth-guard may be constructed using plastic or rubber materials or a combination thereof.

Figure 1A:
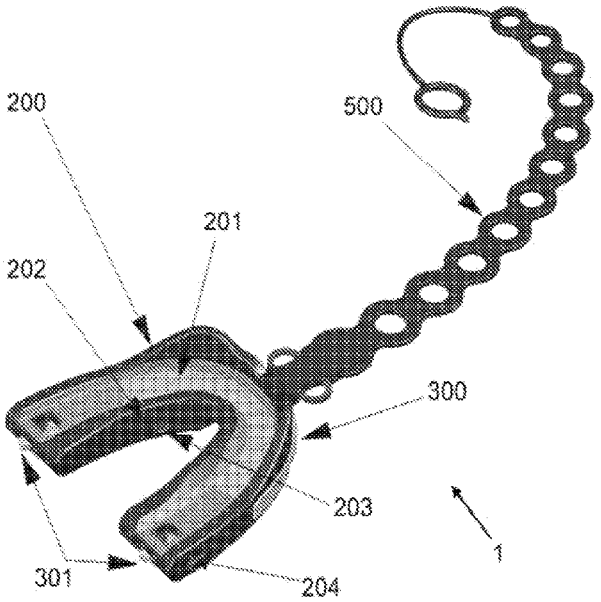
FIGS. 1A and 1B depict a mouth-guard according to an exemplary embodiment.
Figure 1B:
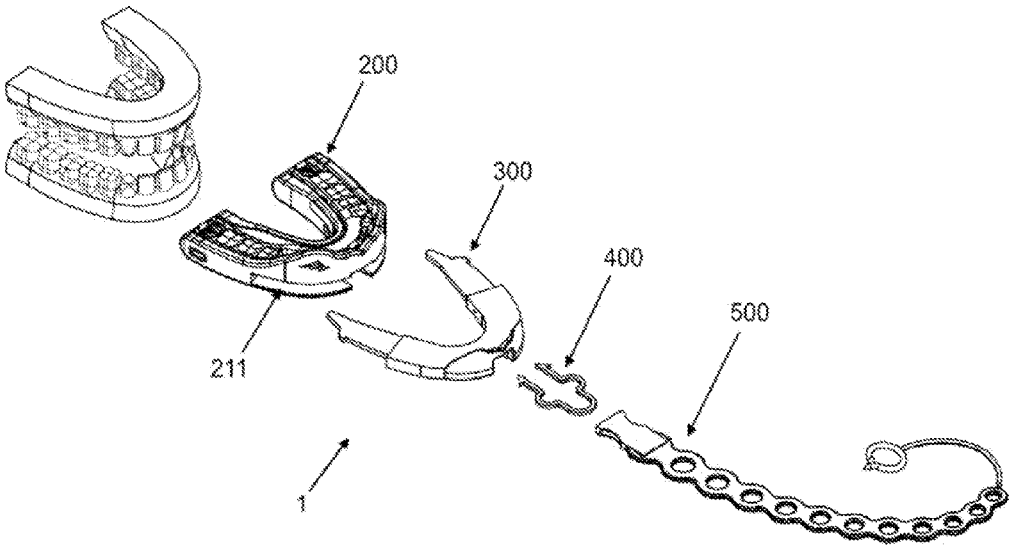

FIGS. 1A and 1B illustrate an assembled and exploded view of an assembly of the mouth-guard 1. As shown, mouth-guard 1 may comprise a main body 200, an insert 300, a lock ring 400, and a strap 500.

Main Body

Figure 2A:
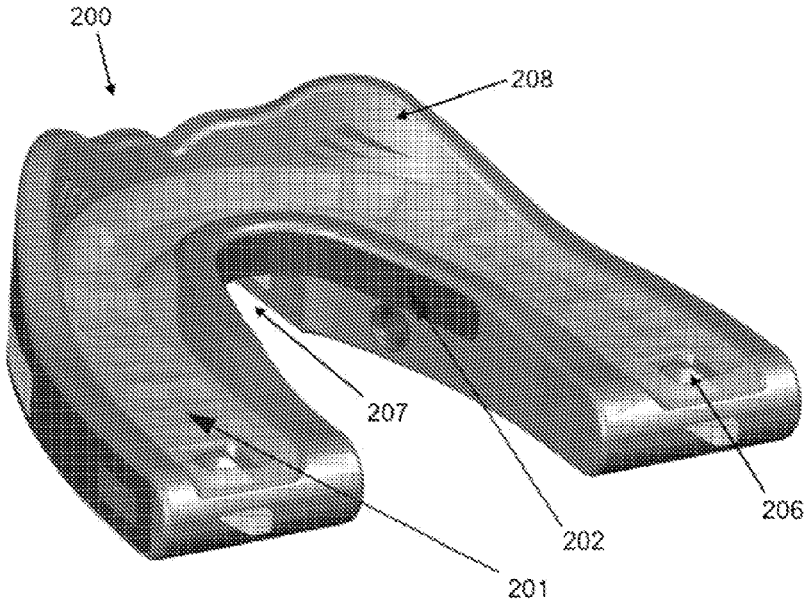
FIGS. 2A and 2B depict a main body of a mouth-guard according to an exemplary embodiment.
Figure 2B:
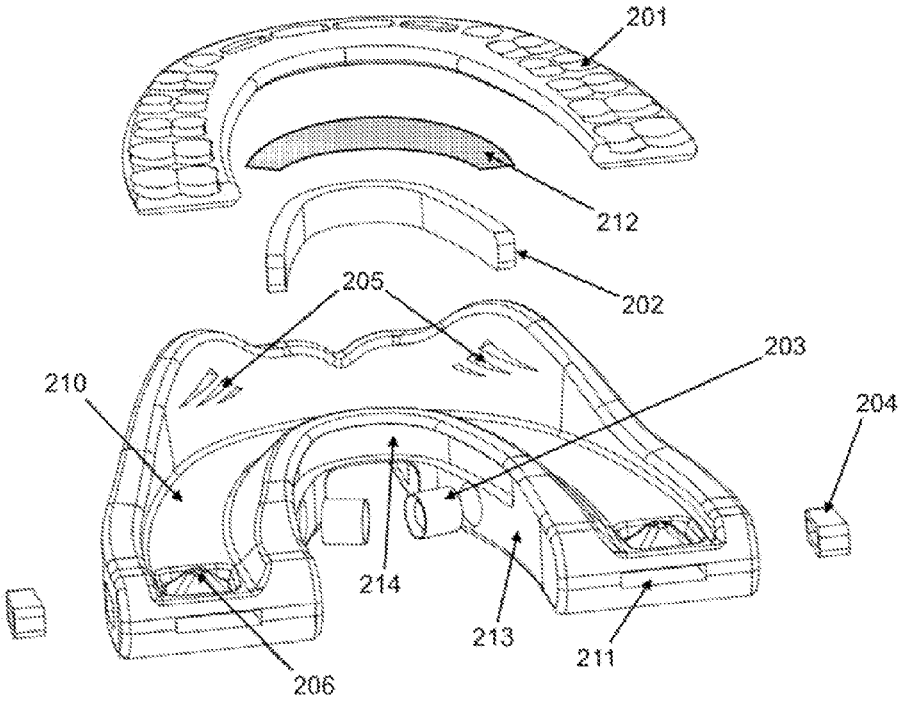
Figure 4A:
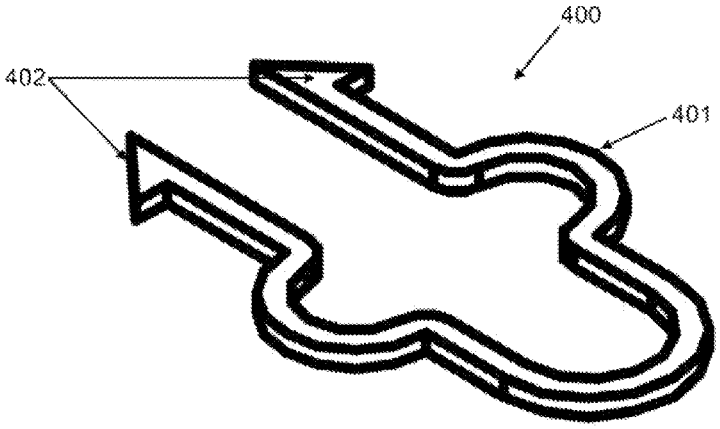
FIGS. 4A and 4B depict a lock ring according to an exemplary embodiment.
Figure 4B:
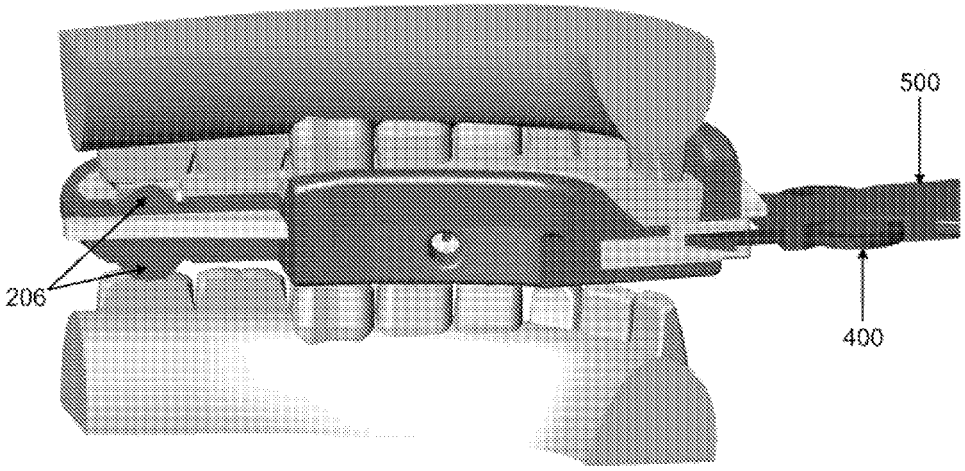

The main body 200, as shown in FIGS. 2A and 2B, is formed as a U-shaped object with a channel 210 through its center configured for the user's teeth to be located therein. In embodiments, the main body 200 includes one or more gum protrusions adjacent to the channel 210 and a slot 211. FIGS. 2A and 2B illustrate a single upper gum protrusion 208. The one or more gum protrusions may include air vents 205 to promote air circulation to the user's mouth, Towards the rear side, the main body 200 may comprise, one or more molar protrusions 206 located in a cavity in the channel 210. As shown in FIG. 2B, each molar protrusion 206 is located within a cavity and is configured to interface with the center of a molar tooth. For example, FIG. 4B shows the interaction between two molar protrusions 206 and a user's teeth. This interaction is intended to secure the user's jaw during collisions and provide a stabilizing effect to combat concussions. In embodiments, a gel layer 201 fits in the channel 210. The gel layer 201 provides a soft cushion layer for the user's upper teeth and may be molded using a boil-and-fit procedure to provide a customized fit for the user's upper teeth. The gel layer 201 may be attached to the channel 210 after being customized.

In embodiments, the main body 200 includes a hydration strip 202 that is affixed within a cavity 214 located on inner surface 213. The user may contact the hydration strip 202 with his or her tongue to release nutrients and/or hydration. In embodiments, the hydration strip 202 may contain enzymes that aid is combating Xerostomia (dry mouth). See 'Composition of Hydration Strip' section below for an exemplary composition of the hydration strip 202, The hydration strip 202 may be enclosed by a mesh cover 212. In embodiments, the main body 200 includes one or more orifices 203, each of which communicate with the insert that fits inside slot 211. In embodiments, the main body 200 includes one or more lock channels 204, which are used to secure the insert 300. The main body 200 may include a respiration hole 207, which ensures sufficient airflow for user inhalation and exhalation. The respiration hole 207 may also allow the user to drink additional fluids without removing the mouth-guard (i.e., from a bottle being poured through respiration hole 207, through a squeeze bottle directed through respiration hole 207, or through a straw passing through respiration hole 207).

Insert

Figure 3A:
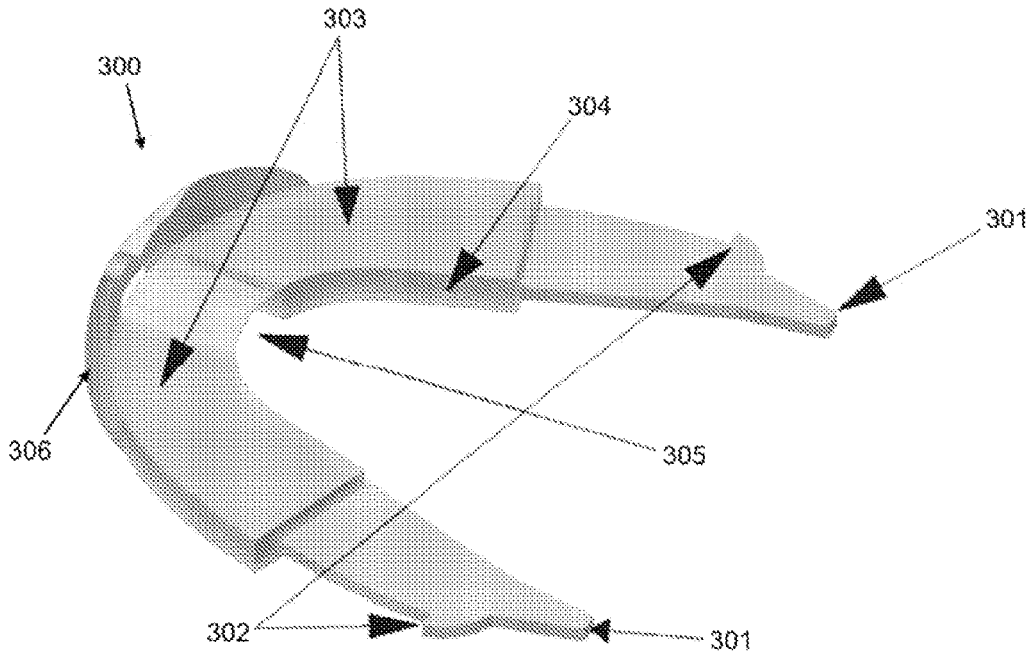
FIGS. 3A and 3B depict an insert for a mouth-guard according to an exemplary embodiment.

FIG. 3A shows exemplary insert 300. In embodiments, insert 300 includes one or more liquid chambers 303 and one or more initial orifices 304 that allow liquid to travel from the liquid chambers 303 to orifices 203 of the main body and finally to the user's mouth. The liquid chambers 303 may be solid compressible containers (made from plastic, metal, or rubber), plastic bags, or pouches. The liquid chambers 303 may be configured to be replaceable or the entire insert may be replaceable. In embodiments, the liquid chambers 303 contain water or another liquid intended to aid in hydrating the user and to augment the user's physical performance. The liquid may include carbohydrates, electrolytes, or any other substance intended to help the user physically perform (see 'Composition of Hydration Liquid' section below for an exemplary composition of the liquid). In embodiments, the liquid chambers 303 are configured such that the user compresses the mouth-guard 1 in his or her teeth such that the internal volume of the liquid chambers 303 is reduced such that liquid is forced through initial orifices 304. The initial orifices 304 may include a valve to control the flow of the liquid. In embodiments, the initial orifices include one-way valves such that liquid can be expelled from the liquid chambers 303 but liquid cannot be introduced into the liquid chambers 303 through the initial orifices 304. Further, in embodiments, the insert 300 is configured to include dummy cartridges in place of liquid chambers 303 or may be functional without the liquid chambers 303 installed. The rules for some sports or events may prohibit any substance during the event (e.g., boxing, mixed martial arts, Ultimate Fighting Championship. etc.).

Insert 300 may include one or more lock protrusions 302, which interface with the one or more lock channels 204 of the main body 200. When engaged, the one or more lock protrusions 302 prevent the insert 300 from sliding forward and/or falling out of main body 200. In embodiments, insert 300 includes one or more lock releases 301, which can be used to actuate the one or more lock protrusions 302. As illustrated in FIG. 3A, insert 300 may include a respiration cutout 305 configured to coordinate with respiration hole 207 of the main body 200. In embodiments, insert 300 includes a font flange 306, which insert with the forward surface of main body 200 when insert 300 is fully inserted into the main body 200. The front flange 306 prevents insert 300 from moving too far toward the rear side of main body 200. In the embodiment illustrated in FIGS. 1A-3A, front flange 306 extends only in an upward direction.

Figure 3B:
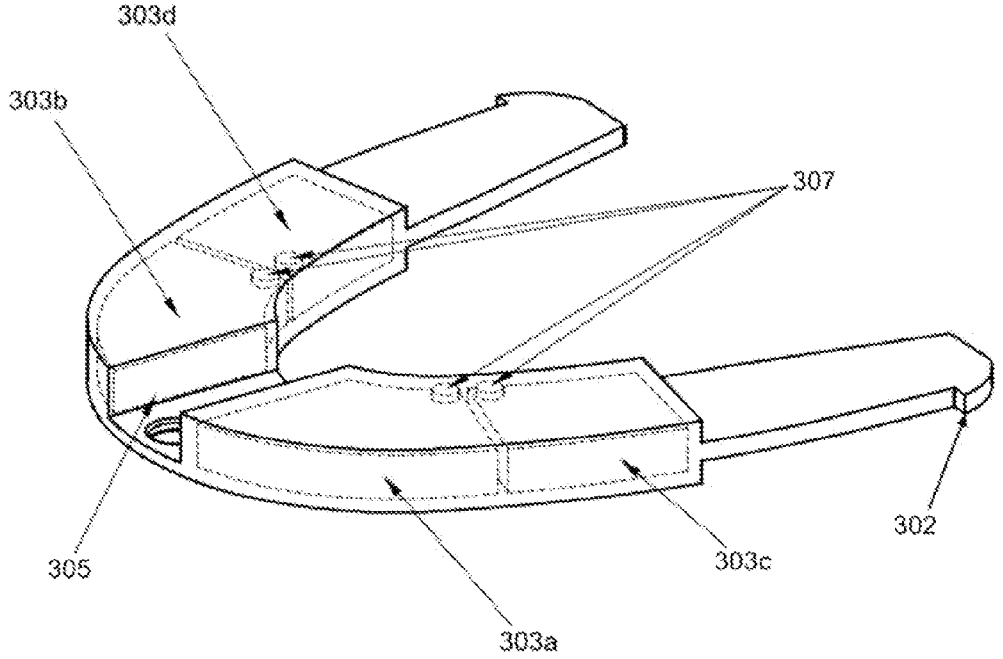

As shown in FIG. 3B, the front flange 306 and one or more lock releases 301 are optional. Further, FIG. 3B) illustrates a configuration with four liquid chambers (303*a*-303*d*). In embodiments, each liquid chamber includes a predetermined break membrane 307. The predetermined break membrane 307 is a portion of the liquid chamber with a thinner wall than the remaining portions of the liquid chamber such that when compressed, the chamber is designed to burst or break at the predetermined break membrane 307 before any other portion breaks. In embodiments, the predetermined break membrane 307 is 0.15 mm thick. The predetermined break membrane 307 may be combined with initial orifice 304 and its associated valve or may be used as an alternative to initial orifice 304 and its associated valve.

Lock Ring and Strap

In embodiments, the mouth-guard I may include a strap 500 attached to the mouth-guard 1 using a lock ring 400. Alternatively, in embodiments, the strap 500 may be permanently attached at the proximal end 501 to main body 200 or to insert 300 (i.e., lock ring 400 would not be necessary). FIG. 4A shows the lock ring 400 and FIG. 4B illustrates a cross-section of lock ring 400 in an installed position attaching strap 500 to insert 300, which is inside main body 200. In embodiments, the strap 500 may facilitate attachment of the mouth-guard 1 to a user's helmet or to the facemask of a user's helmet at the distal end 502 of the strap (e.g., to a football, hockey, or lacrosse helmet).

As shown in FIGS. 4A and 4B, the lock ring 400 may include one or more side protrusions 401 and one or more rear locks 402. In FIG. 4B, rear locks 402 are shown engaged in insert 300. In addition, rear locks 402 may also he configured to interface with main body 200 such that insert 300 can be removed and replaced without removing strap 500. In embodiments, the one or more side protrusions 401 are configured to interface with the strap 500 at the proximal end 501 to secure the lock ring 400 to the strap 500. The assembly may be configured such that the user may press the side protrusions 401 toward the strap 500 to actuate the rear locks 402 and detach the strap from insert 300.

Figure 5:
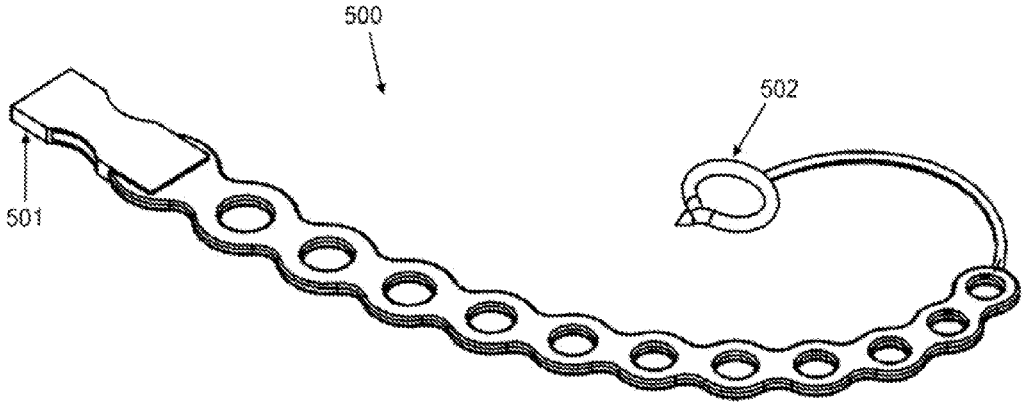
FIG. 5 depicts a strap for a mouth-guard according to an exemplary embodiment.

FIG. 5 illustrates the strap 500 with the proximal end 501 intended to attach to other portions of the mouth-guard 1 and distal end 502 configured to attach the strap to an external object such as a helmet or a facemask.

Lip Guard and Lip Guard Lock

Figure 6:
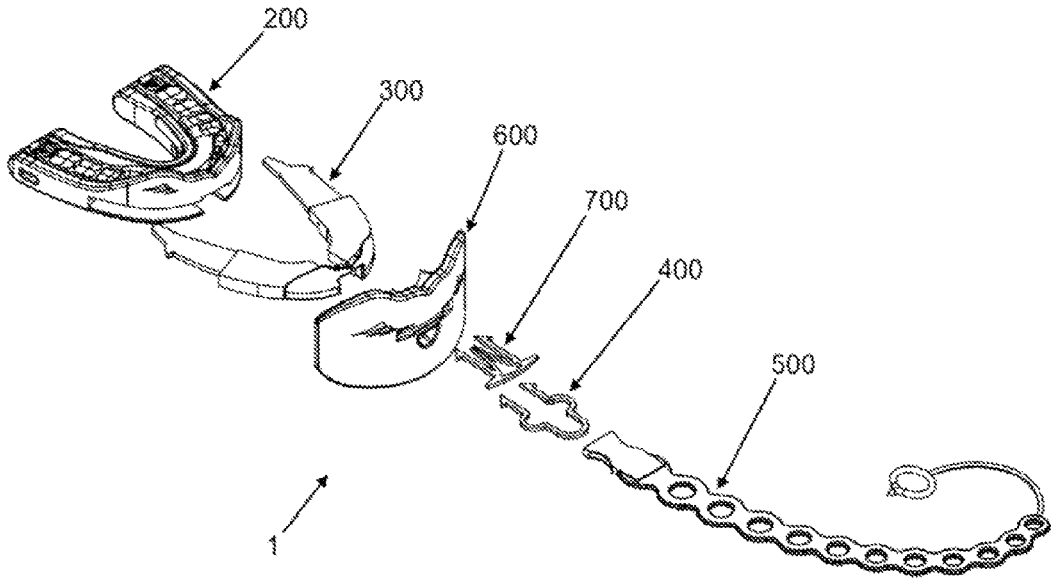
FIG. 6 depicts a mouth-guard assembly with a lip guard according to an exemplary embodiment.
Figure 10A:
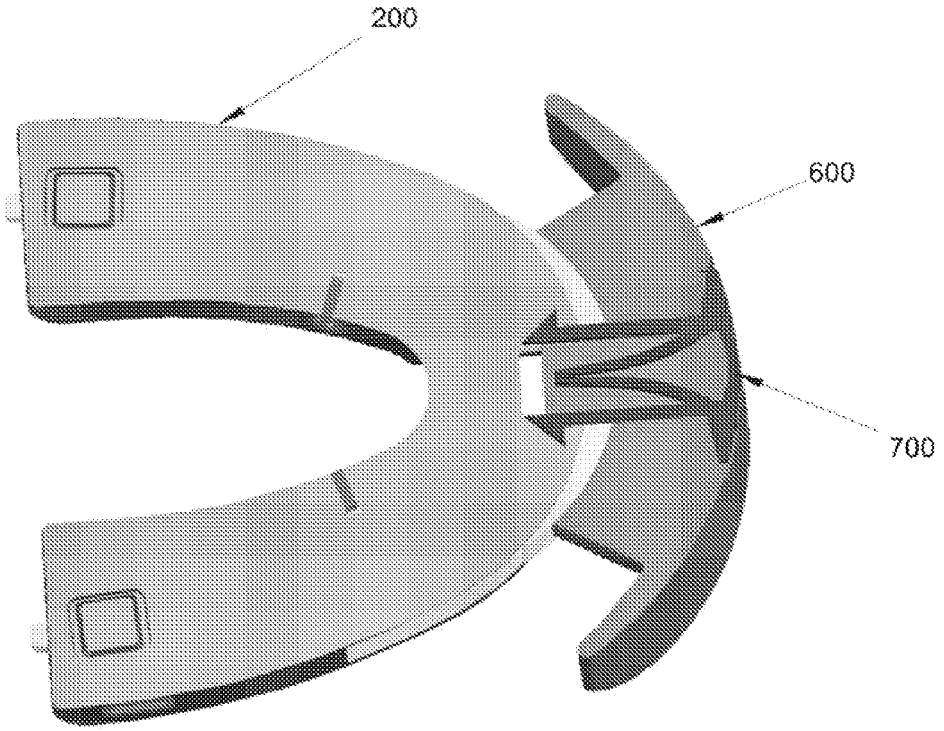
FIGS. 10A and 10B depict operation of a lip guard lock according to an exemplary embodiment.
Figure 10B:
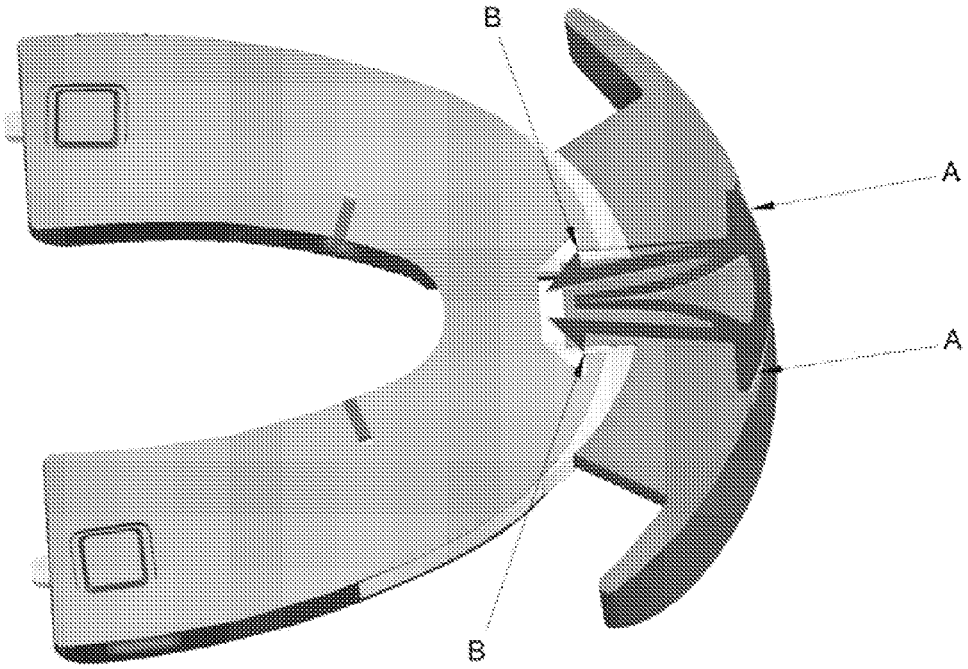

FIG. 6 illustrates an exploded view of an assembly for mouth-guard 1 that includes a lip guard 600 and a lip guard lock 700. In embodiments, the lip guard 600 is a separate component that is attached to main body 200 after insert 300 is engaged within main body 200 where lip guard lock 700 secures lip guard 600 to main body 200. Alternatively, lip guard 600 may be integrally formed as a forward portion of the insert 300 (i.e., lip guard lock 700 would not be necessary). As shown in the cross-sections in FIGS. 10A and 10B, lip guard lock 700 is attached to main body 200 at location B (locked position shown in FIG. 10A). To release lip guard 600, the user presses rearward at positions A to release the locks at position B (unlocked position shown in FIG. 10B).

As shown in FIG. 6, the rear locks 402 of lock ring 402 are configured to pass through lip guard 600. In other words, attachment of the strap 500 using lock ring 400 operates the same whether or not the lip guard 600 is present. Alternatively, the strap 500 may be integrally/permanently attached to the forward side of the lip guard 500 such that lip guard lock 700 secures both lip guard 600 and strap 500 to main body 200. In addition, lip guard 600 and strap 500 may both be permanently attached to the forward side of insert 300 such that both lock, ring 400 and lip guard lock 700 are each rendered unnecessary.

Mouth-Guard with Upper and Lower Gum Protrusions

Figure 7:
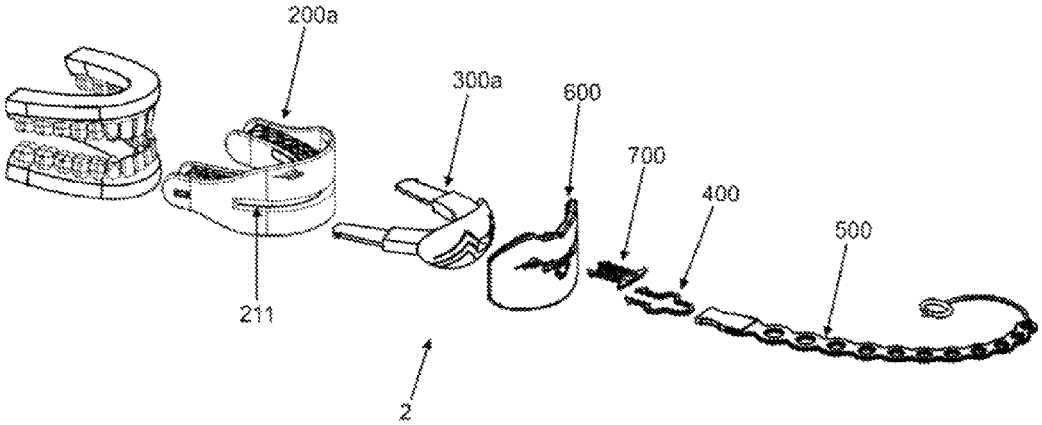
FIG. 7 depicts a mouth-guard with upper and lower gum protrusions according to an exemplary embodiment.
Figure 8:
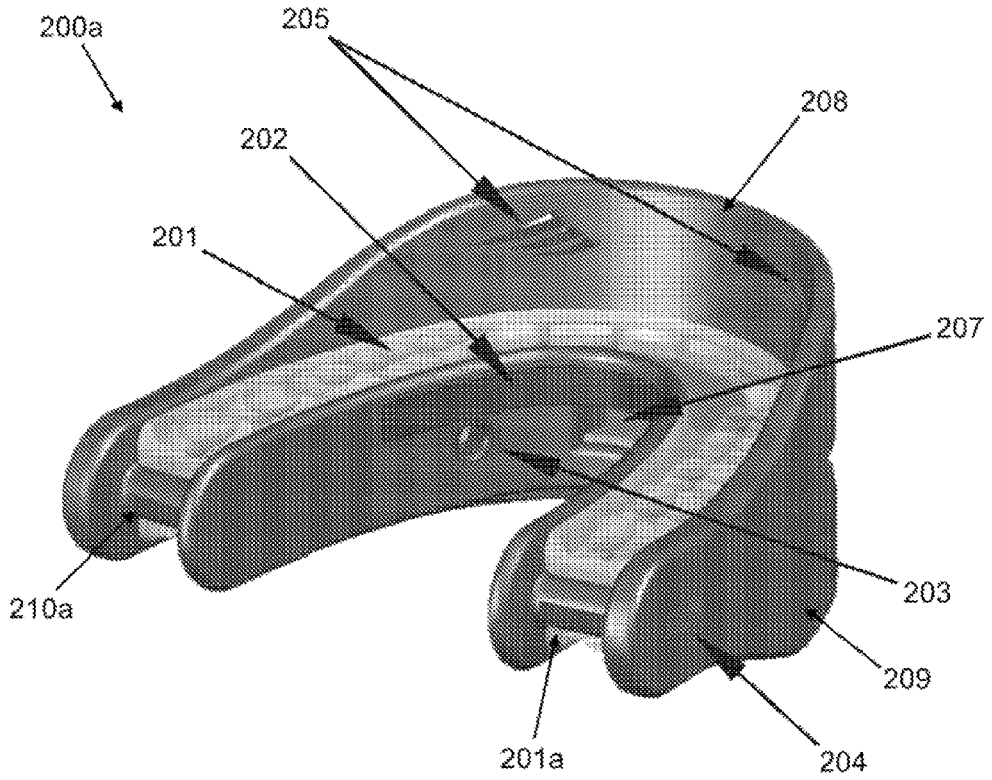
FIG. 8 depicts a mouth-guard main body with upper and lower gum protrusions according to an exemplary embodiment.

In embodiments, as shown in FIGS. 7 and 8, the double sided mouth-guard 2 includes a double sided main body 200*a* with an upper gum protrusion 208 and a lower gum protrusion 209. Many features of double sided main body 200*a* are similar to main body 200 and thus will not be described a second time. Double sided main body 200*a* also has a U-shape and includes a lower channel 210*a* (similar to channel 210) for the user's lower teeth. Similarly, in embodiments, the lower channel 210*a* includes a lower gel layer 201*a*, which can be custom molded to the user's lower teeth.

Figure 9:
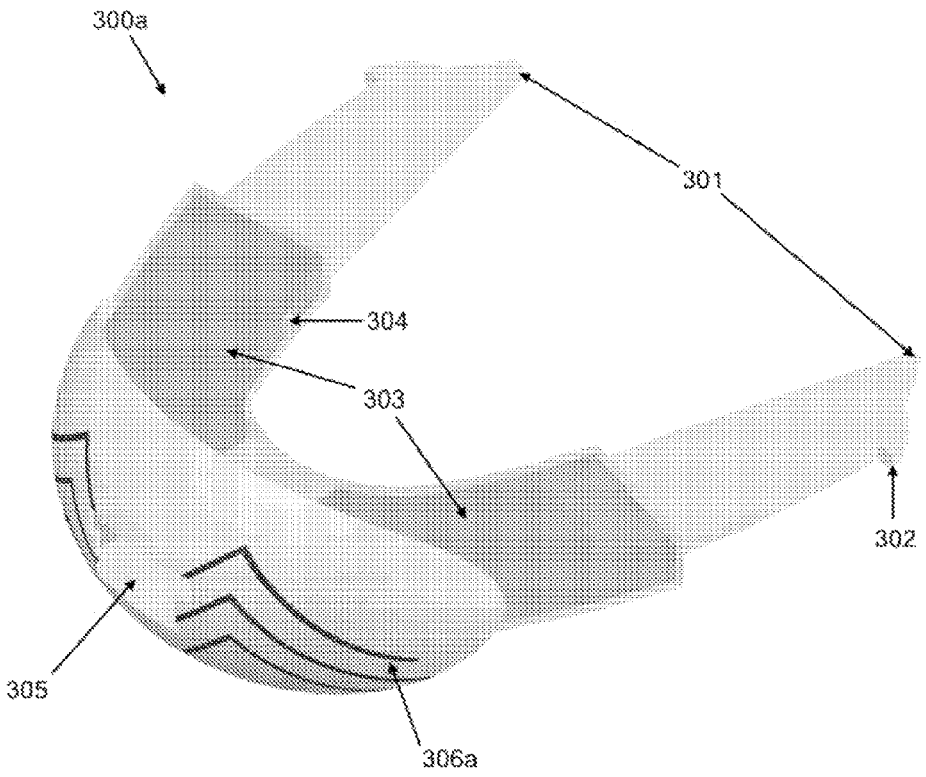
FIG. 9 depicts an insert for a mouth-guard with upper and lower gum protrusions according to an exemplary embodiment.

FIGS. 7 and 9 illustrate a double sided insert 300*a* compatible with double sided main body 200*a* and interfaces with slot 211. Unlike insert 300, double sided insert 300*a* includes a double sided front flange 306*a* extends in an upward direction and in a downward direction, As shown in FIG. 7, double sided mouth-guard 2 is compatible with lock ring 400, strap 500, lip guard 600, and lip guard lock 700.

Composition of Hydration Strip

Described herein is an exemplary composition of the hydration strip. The hydration strip may include: filtered water (17.8275%), granulated sugar (40.5%); corn syrup 42/43 (40.5%); citric acid (0.85%); hard candy blend (0.288%); FD&C yellow #5 powder (0.0045%); and tropical flavor (0.03%).

Composition of Hydration Liquid

Described herein is an exemplary composition or the hydration strip. The hydration strip may include: filtered water (98.2695%); sodium benzoate (0.03%); potassium sorbate (0.03%); gummy blend (0.8035%); Splenda Sucralose—liquid concentrate (0.05%); acesulfame potassium (0.002%); TIC Pretested Pectin 1694 Powder (0.3%); citric acid (0.45%); natural bitterness blocker (0.04%); and tropical flavor (0.025%).

What is clamed is:

1. A mouth-guard comprising:

a main body including a channel, one or more gum protrusions, a slot, a hydration strip, and a mesh cover to cover the hydration strip; and an insert configured to be inserted into the slot.

2. The mouth-guard according to claim 1, wherein the insert includes:

one or more liquid chambers;

one or more initial orifices on a surface of the insert, each initial orifice being configured to transport liquid from the one or more liquid chambers to an orifice of the main body, wherein liquid passes through the orifice of the main body into a mouth of a user when compressed by the user.

3. A method of using a mouthpiece according to claim 2 comprising:

compressing the mouth-guard between the user's upper and lower teeth such that an internal volume of the one or more liquid chambers is reduced to force liquid through the initial orifices to the orifices of the main body.

4. The mouth-guard according to claim 1, wherein the main body includes a gel layer disposed in the channel.

5. The mouth-guard according to claim 4, wherein the gel layer is attached to the bottom of the channel using adhesive.

6. The mouth-guard according to claim 1, wherein the main body includes one or more protrusions at a rear end of the channel.

7. The mouth-guard according to claim 6, wherein each protrusion has a pyramid or a cone shape.

8. The mouth-guard according to claim 1, wherein the insert includes one or more locks for securing the insert in the main body.

9. The mouth-guard according to claim 1, further comprising a lip guard.

10. The mouth-guard according to claim 1, further comprising a strap attached to the mouth-guard using a lock ring.

11. The mouth-guard according to claim 1, further comprising a respiration hole.

12. The mouth-guard according to claim 1, wherein the insert includes a front flange.

13. The mouth-guard according to claim 1, further comprising an upper gum protrusion and a lower gum protrusion.

14. A method of using a mouthpiece according to claim 1 comprising:

contacting the hydration strip with a tongue of a user to release nutrients and/or hydration.

* * * * *